United States Patent [19]

Edwards et al.

[11] Patent Number: 4,990,757

[45] Date of Patent: Feb. 5, 1991

[54] METHOD AND APPARATUS FOR VEHICLE STORAGE AND RETRIEVAL

[75] Inventors: Glen J. Edwards, Tuckahoe, N.J.; James R. Nelson, Kennett Square, Pa.; Richard R. Wier, Jr., Wilmington, Del.

[73] Assignee: Valet Parking Associates, Inc., Wilmington, Del.

[21] Appl. No.: 288,264

[22] Filed: Dec. 22, 1988

[51] Int. Cl.[5] ..... G07B 15/02

[52] U.S. Cl. ..... 235/384; 235/375

[58] Field of Search ..... 235/375, 384

[56] References Cited

U.S. PATENT DOCUMENTS 4,303,904 12/1981 Chasek ..... 235/384

*Primary Examiner*—Harold I. Pitts

*Attorney, Agent, or Firm*—Paul E. Crawford

[57] ABSTRACT

Method and apparatus for storage and retrieval of vehicles, particularly in parking lots surrounding shopping malls, airports, stadiums and the like is disclosed. The method includes identification of the vehicle owner and the stored vehicle with a common code utilizing a two part identifier. The first part of the identifier is used to imprint an identifying code on the vehicle owner and is also attached to the vehicle while it is stored. The second part of the identifier with the same code is attached to the vehicle's keys which are kept in a secure facility. The vehicle's description and location in the parking lot is recorded on the second part and is also inputed to a central computer which maintains data on each vehicle stored. When the vehicle owner wants to retrieve his or her vehicle, the code inprinted on the owner is read and transmitted to the area where the vehicle is stored along with the location where the vehicle is to be delivered. That code is used to locate the vehicle in the parking area, which is then driven to the location desired by the vehicle owner.

14 Claims, 2 Drawing Sheets

METHOD AND APPARATUS FOR VEHICLE STORAGE AND RETRIEVAL

BACKGROUND OF THE INVENTION

Over the past thirty years shopping malls have continuously grown in size and complexity. Often the malls are surrounded by a bewildering array of parking options spread over a large geographical area. In many instances, mall parking is available in multilevel garages. One seeking to find a vehicle in these garages must remember the particular garage, level, row and space where he or she parked the vehicle. Similarly, in open parking lots surrounding a mall the search for a vehicle can be equally, if not more, bewildering. This is especially true if a vehicle is parked in the daylight and sought to be retrieved after nightfall. The change in lighting causes ones perspective to change making it difficult to locate a vehicle. Similarly, if a vehicle is parked when a lot is relatively empty and then retrieved after the lot fills up, the owner's impression of the vehicle's location can also change.

Compounding these difficulties are the issues of safety and weather. A recent study by the Bureau of Justice Statistics reports that there were more than four hundred thousand violent crimes in parking lots in 1985 alone. A single mall in New Jersey reported an annual average of 2 rapes, 16 robberies, 78 assaults, 173 burglaries, 670 larcenies and 202 motor vehicle thefts. The fear of such crimes has led to increased police patrols of parking lots, television surveillance, stakeouts and the like. All of these measures are, however, palliative, not preventive. In addition they are expensive.

In many climates, both in the north and south, the weather can deter shopping. The prospect of walking several hundred yards from vehicle to store in biting cold weather to do Christmas shopping is a serious deterrent to many shoppers. Conversely, extreme heat and humidity can deter shoppers at any time of the year, especially the elderly. The prospect of returning to a vehicle that has been baked by 90° sun for several hours is similarly not very pleasant.

Most of the abovementioned negatives surrounding mall parking lots and parking garages apply equally well to other areas such as shopping centers, airports, sports complexes and the like.

One solution to such problems might be the provision of traditional valet parking for customers. Traditional valet parking operations, however, have several drawbacks. First, such operations are typically operated out of a single location. Thus, if a shopper were to drop off a vehicle at that location in a mall and to proceed to the opposite end of the mall he or she would have to backtrack to the drop-off location to retrieve the vehicle. Failing this, the shopper more frequently chooses not to venture far from the parking entrance location, thus discouraging cross-mall shopping.

A second drawback of the typical valet parking system is the method used to record and verify vehicle ownership. In the traditional valet system a two part printed ticket is used with one half given to the vehicle owner and the other haphazardly placed on the vehicle dashboard or under the windshield wiper. This system often results in loss of the owner's ticket half when misplaced in pocket or purse, especially during shopping when the owner is constantly reaching in pocket or purse for credit cards, money, etc. Theft of the owner's ticket half is also an ever present danger. Conversely, the other half of the ticket is easily lost if, for example, placed under the windshield wiper of the vehicle. Or the readily visible number on the ticket can be read by someone who can use that number to illegally claim ownership by feigning the loss of his or her ticket half. In addition, the vehicles, once parked by the valet service, are generally unattended and thus subject to theft or vandalism.

SUMMARY OF THE INVENTION

All of these and many other problems of prior art vehicle storage and retrieval systems are avoided by the claimed invention.

In applicants' invention all of the impediments and drawbacks of mall parking are eliminated. The mall patron wishing to have his or her vehicle parked can go to any one of several drop-off areas at mall and/or store entrances manned by trained parking personnel (greeters). After examination for any obvious damage the vehicle is taken to an area supervised and controlled by someone at all time (control attendant). Retrieval is controlled in a unique manner which all but eliminates loss of the vehicle or theft by unauthorized claims.

At the drop-off area, a unique hand stamp/key ring identifier is used by the greeter to facilitate identification, location and retrieval of the vehicle and assure return of the vehicle to its owner. This identifier comprises two parts which can be mated by friction fit or like means. One part contains a printed number or other identification code, plus a matching raised area with the same code that is used as a hand stamp. The vehicle owner's hand is stamped by the greeter with the identification code of that particular identifier using ink visible only under ultraviolet light. The other part of the identifier contains a space for logging the parked vehicle's identification (color, make, style, etc.) along with its parked location in the parking lot or garage. The greeter logs information in that space before turning the identifier over to a driver. The keys to the vehicle are attached to the second part by the driver and taken to the control attendant located at designated locations in the parking lot or garage. The first part of the identifier with the hand stamp and number is hung by the driver on the visor of the parked vehicle.

The control attendant is typically located in one or more kiosks stratigically placed in the parking lot or garage and takes the key ring with the identifying information and enters that information into a terminal/-transmitter which relays that information to a central computer.

When the vehicle owner is ready to leave the mall he/she may go to anyone of several pick up/drop off locations in the shopping mall or store even though that location is different from the location where the vehicle was dropped off. At the exit is a cashier at a specially designed booth. The owner pays for the parking service. The owner places his/her hand under an ultraviolet light. The cashier calls up the car on the computer and scans the information about the vehicle on a terminal screen. The cashier then sends via the central computer a message to the control attendant at the kiosk closest to where the vehicle is located. The computer terminal at the kiosk prints out a ticket identifying the vehicle, its location, and the exit where the vehicle is to be taken. The cashier's printer prints out a separate two-part receipt for the owner.

The control attendant gives the ticket, and the part of the identifier containing the vehicle keys to a driver who locates the vehicle and drives it to the pick up exit. He gets the receipt from the owner, retrieves the unique hand stamp portion of the identifier and delivers the vehicle to the owner. He places the receipt and hand stamp/key ring portions of the identifier at a designated location by the greeter. He is then ready to take another car.

DESCRIPTION OF THE PREFERRED EMBODIMENT

Figure 1:
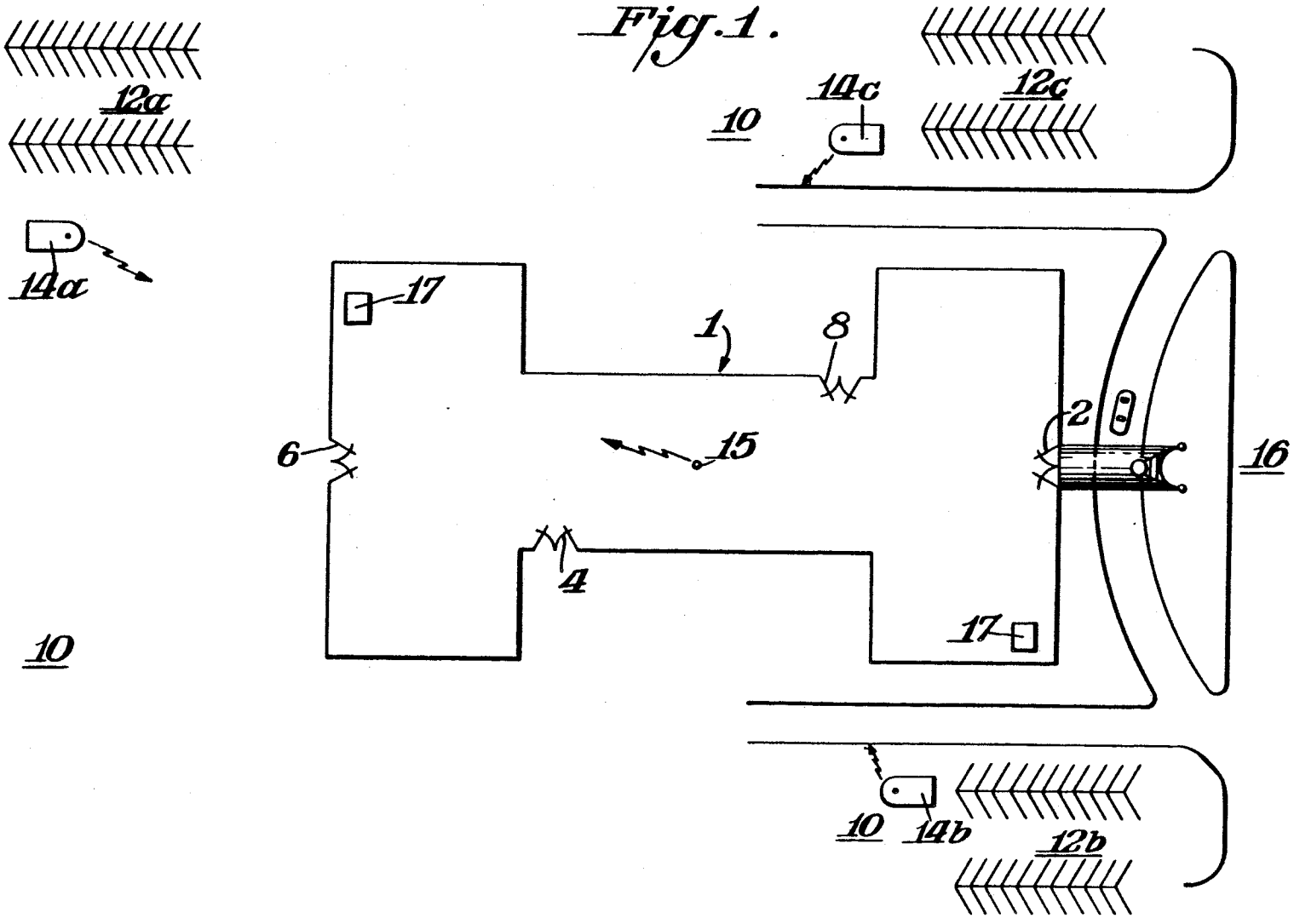
FIG. 1 is a schematical top plan view of a typical mall or store with multiple entrances and exits surrounded by a large expanse of parking.
Figure 2:
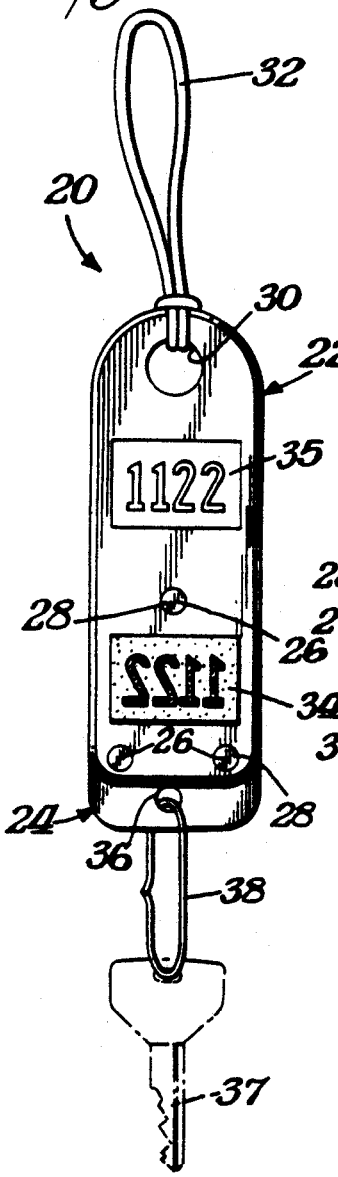
FIG. 2 is a front elevational view of the unique two part vehicle, person and key identifier in assembled form which forms part of this invention.

FIG. 1 illustrates a typical mall or shopping area comprising a mall building 1 with numerous stores therein and multiple entrances 2, 4, 6 and 8. As shown in FIG. 1 building 1 is surrounded by parking area 10. Within the overall parking area 10 are several areas 12*a–c* designated for parking vehicles in accordance with this invention. These vehicles are taken to areas 12*a–c* which are monitored and secured by control attendants located in kiosks 14*a–c*. Typically the areas 12*a–c* will be located in an area of the parking lot 10 which is not heavily used by regular patrons.

Figure 3:
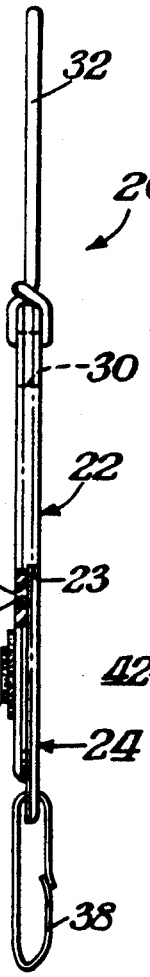
FIG. 3 is a side elevational view of the two part identifier in assembled form.
Figure 4:
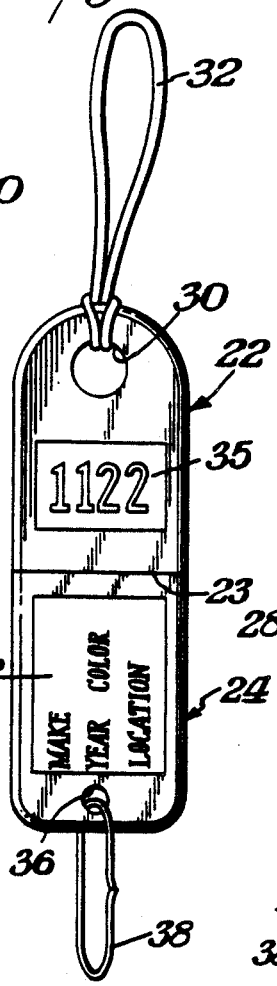
FIG. 4 is a rear elevational view of the two part identifier.
Figure 5:
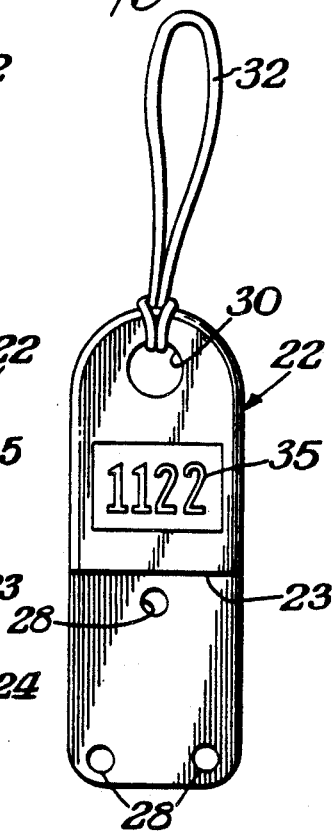
FIG. 5 is an elevational view of the tag identifier with the key holder portion of the identifier removed.
Figure 6:
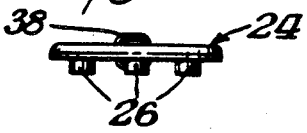
FIG. 6 is a top plan view of the key holder portion of the identifier.
Figure 7:
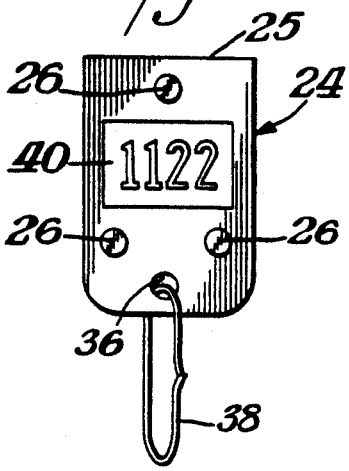
FIG. 7 is a front elevational view of the detached key holder portion of the identifier.

Dedicated parking areas are not necessary to the operation of this invention because, as discussed below, the location of stored vehicles in lot 10 can be readily ascertained by identifier means, 20 and data stored in a computer used in conjunction with this invention. Identifier 20 as illustrated in FIGS. 2–7 comprises two parts 22 and 24 which may be held together by the friction fit of pegs 26 on the second identifier part 24 into holes 28 of the first identifier part 22. Other means of removably securing the two parts will be readily apparent to those skilled in the art. As illustrated in FIGS. 3–5, the first identifier part 22 has a recessed area 23 which mates with the upper edge 25 of the second identifier part 24 to facilitate the mating of these parts.

First identifier part 22 as illustrated is a generally flat, elongated plastic part with an opening 30 at one end containing an elasticized band 32 of sufficient length to permit attachment of first identifier part 22 to the rear view mirror or sun visor of a stored vehicle. Mounted on one surface of first identifier part 22 is a raised identification code 34 which can include numerals as shown, letters, symbols or combinations of same. The raised identification code 34 is similar to those found on rubber stamps. Imprinted on first identifier part 22 is a matching identification code 35.

Second identifier part 24 mates with the first identifier part 22 in the manner previously described. It contains an opening 36 for attachment of vehicle key 37 retention means 38. Imprinted on part 24 is an identification code 40 which corresponds to the codes 34 and 35 on first identifier part 22. Part 24 also contains an erasable surface 42 for entry of vehicle identification information such as year, color and make as well as information on the vehicle's location in parking areas 12*a–c* or in the general parking area 10.

One feature of this invention is that a mall patron has complete shopping flexibility without concern as to the location of his or her parked vehicle. Thus, a patron may enter mall 1 at the main entrance 2 thereto and proceed through some or all the shops in the mall to entrances 4, 6 or 8 and still have immediate access to the vehicle. Alternatively the patron could enter the mall at any of the entrances and leave by the same or different entrances.

When a patron first stops at any one of the entrances 2, 4, 6 or 8 he or she is met by a greeter. The function of the greeter is to signal the driver where to stop, to open his door, and to apply an invisible ink hand stamp to the owner's hand using the raised identification code 34 on first identifier part 22. The greeter may also log certain information on surface 42 of identifier 20. While the greeter is performing this function, one of many drivers will discretely circle the vehicle, noting any existing damage to the automobile. Seeing none, the driver will take both parts 22 and 24 of vehicle identifier from the greeter and drive off with the vehicle to remote parking areas 12*c–a* or other identifiable area within parking lot 10. If the greeter sees damage, he will note the nature of the damage on a pre-printed card. This card will be kept as a business record.

The driver, meanwhile, takes the vehicle to the designated remote parking areas 12*a–c* parks it in a numbered parking space and attaches the first identifier part 22 to the mirror or visor with attachment means 32. The second identifier part 24 is then detached from part 22 and attached to the vehicle's keys 37 with attachment means 38, typically a spring type mechanism. The driver then locks the vehicle and marks on surface 42 a code signifying identification and location of the vehicle. The driver then gives the keys to a control attendant stationed in kiosks 14*a–c*. The driver then returns, either by foot or by a return vehicle to mall building 1 to pick up additional vehicles or .delivers a vehicle to an owner at any one of the mall entrances 2, 4, 6, and 8.

The control attendants stationed in kiosks 14*a–c* perform several important functions. The first is the supervision of the remote parking areas 12*a–c* to insure that no one, except authorized drivers, approaches any vehicle. Second, the remote parking attendant becomes the custodian of the keys for the locked and parked automobiles, storing the keys in the kiosks 14*a–c* under his control. Third, the control attendant enters the information on identifier part 24, including the vehicle identification and location, into a data terminal linked to a central computer. The computer will accept all data, and will automatically assign the time of the day as well as indicating the drop-off point of the vehicle.

A patron using this invention may leave from any of the mall entrances 2, 4, 6 or 8 that are served by this service, and not necessarily at the point at which he or she dropped off the vehicle. To pick up the vehicle, the customer would first approach a cashier who would be stationed at a small identifiable kiosk just inside several of the entrances 2, 4, 6 and 8. This kiosk would be equipped with an ultraviolet light to read the identification code previously stamped on the vehicle owner's hand. The cashier would input the now visible number into a computer terminal at that location which would display all data on the stored vehicle previously inputted by the control attendant.

Once this data is confirmed by the person claiming the vehicle, and after payment is received, the cashier transmits to the control attendant at one of the remote locations 14 where the stored vehicle's key is located information used to print a ticket identifying the vehicle, its location and the drop off location to which the vehicle is to be delivered. A driver then uses this ticket to locate the vehicle and bring the vehicle from the remote area where it has been stored to the selected drop off location at entrances 2, 4, 6 or 8. At the cashier's station a two part claim check is produced by a printer. One part of the claim check is retained by the vehicle owner as a receipt and the other part is presented to the driver who delivers the vehicle to confirm ownership of the vehicle being delivered. The driver matches the identification code on the claim check presented to him with the code on the ticket he picked up from the control attendant and the number 35 on identifier 20. After the vehicle is delivered, the driver will remove the first identifier part 22 from the vehicle and the second identifier part 24 from the keys and connect the two parts together. He will place the identifier and the receipt at a location near the greeter.

Data terminals at entrances 2, 4, 6 and 8 and the remote parking kiosk 14 are linked with a central computer via radio and telephone lines. Data base station(s) 17 and an antenna(e) 15 are used to channel radioed transmissions to and from the various communications sources into and out of the central computer. Communication from the base stations 17 to the central computer (not illustrated) is over a voice grade telephone line.

We claim:

1. A method for storage and retrieval of vehicles near a building having multiple entrances and a large parking area adjacent the building comprising:

(a) deposit of the vehicle with a greeter at a first building entrance;

(b) identification of the vehicle and person depositing the vehicle with a common identification code;

(c) transfer of the vehicle from the first building entrance to an identifiable portion of the parking area where the vehicle is stored under the control of a control attendant;

(d) communication of the vehicle identification code and building entrance to which the vehicle is to be delivered to the control attendant;

(e) delivery of the vehicle from the parking area to the communicated building entrance.

2. The vehicle storage and retrieval method recited in claim 1 wherein the vehicle and person depositing the vehicle are identified utilizing a multiple part identifier, the first part of that identifier containing raised numbers used to stamp an identification code on the person depositing the vehicle.

3. The vehicle storage and retrieval method recited in claim 2 wherein the first part of the identifier is attached to the vehicle when stored.

4. The vehicle storage and retrieval method recited in claim 2 wherein a second part of the identifier is attached to the vehicle's keys and retained by the control attendant while the vehicle is stored.

5. The vehicle storage and retrieval method recited in claim 2 wherein the vehicle identification code communicated to the control attendant is determined by observing the number stamped on the person depositing the vehicle at the time the person requests return of the vehicle.

6. The vehicle storage and retrieval method recited in claim 2 wherein the location and identifying characteristics of the stored vehicle are entered on the second part of the identifier.

7. The vehicle storage and retrieval method recited in claim 1 wherein a stored vehicle may be delivered to any of the building entrances requested by the vehicle owner.

8. A vehicle storage method comprising:

(a) deposit of the vehicle to be stored with a greeter at a first location;

(b) stamping an identification code on the body of the person depositing the vehicle using a two-part vehicle identifier, the first part of the identifier containing raised numbers utilized to apply the identification number;

(c) transfer of the vehicle from the first location along with the two-part identifier;

(d) attachment of the vehicle keys to a second part of the identifier and delivery thereof to a secured facility.

(e) attachment of the first part of the identifier to the stored vehicle.

9. A method of retrieving a vehicle stored in accordance with claim 8 wherein:

(a) the person depositing the vehicle displays the stamped identification code to a cashier at the first or other locations;

(b) communication of the identification code by the cashier to personnel at the secured facility;

(c) matching of the communicated identification code with a corresponding number on the second part of the identifier retained in the secured facility;

(d) delivery of the stored vehicle to the communicated location.

10. Apparatus for use in the storage and retrieval of vehicles comprising first and second identifier parts capable of being joined together, the first identifier part having raised numbering thereon used to stamp an identification code on the person seeking to store the vehicle and the second identifier part having the same code located thereon, and also containing means for attaching the vehicle keys thereto while the vehicle is stored.

11. The apparatus recited in claim 10 wherein the first identifier part contains means for attaching the part to the vehicle while stored.

12. The apparatus recited in claim 10 wherein the second identifier part contains means for entering the identity and location of the vehicle being stored.

13. The apparatus recited in claim 10 wherein the second identifier part contains means for attaching the keys of the vehicle being stored.

14. The apparatus recited in claim 10 wherein the first and second identifier parts are joined together by friction fit.

* * * * *